US005897304A

United States Patent [19]

Kaneko

[11] Patent Number: 5,897,304

[45] Date of Patent: Apr. 27, 1999

[54] FLOW-THROUGH VERTICAL FILLING PUMP WITH A PLURALITY OF DIAPHRAGMS

[75] Inventor: Yutaka Kaneko, Wheeling, Ill.

[73] Assignee: Tetra Laval Holdings & Finance, SA, Pully, Switzerland

[21] Appl. No.: 08/767,081

[22] Filed: Dec. 16, 1996

[51] Int. Cl.[6] ..... F04B 39/00

[52] U.S. Cl. ..... 417/552; 417/547; 417/549; 417/570; 92/980

[58] Field of Search ..... 417/552, 547, 417/549, 570; 92/980 D

[56] References Cited

U.S. PATENT DOCUMENTS

| | | | |
|---|---|---|---|
| 200,026 | 2/1878 | Burgess . | |
| 221,494 | 11/1879 | Barnes . | |
| 245,067 | 8/1881 | Hess . | |
| 2,776,785 | 1/1957 | Lyon | 222/318 |
| 2,894,665 | 7/1959 | Zerlin | 222/378 |
| 3,473,479 | 10/1969 | Sundholm | 103/218 |
| 3,695,787 | 10/1972 | Kraus | 417/547 |
| 4,832,583 | 5/1989 | Brown | 417/417 |
| 4,934,906 | 6/1990 | Williams | 417/388 |
| 5,090,299 | 2/1992 | Santi et al. | 92/98 D |

*Primary Examiner*—Timothy S. Thorpe
*Assistant Examiner*—Daniel E. Moses

[57] ABSTRACT

A flow-through filling pump for receiving a liquid supply and discharging a predetermined amount of the liquid therefrom includes a housing defining a supply chamber and a discharge chamber and a reciprocating piston positioned in the housing intermediate the supply and discharge chambers. The piston is movable along an axial liquid flow path defined by the chamber, between a fill position and a discharge position. A drive assembly is operably connected to the piston to drive the piston between the fill and discharge positions. A seal member extends between the piston and the housing to isolate the supply and the discharge chambers and at least a portion of the piston from a portion of the housing at which the drive assembly operably connects to the piston. The pump includes a non-return type inlet valve mounted to the piston. The inlet valve has a biasedly mounted valve element, which is biased to the closed position. The inlet valve is moveable with the piston and the valve element is movable relative to the piston to permit and to terminate flow of liquid through the valve into the discharge chamber as the piston is moved between the fill and discharge positions.

20 Claims, 4 Drawing Sheets

FLOW-THROUGH VERTICAL FILLING PUMP WITH A PLURALITY OF DIAPHRAGMS

FIELD OF THE INVENTION

This invention relates to a liquid filling pump. More particularly, the invention relates to a vertically oriented, flow-through pump having a straight flow profile for liquid pumping applications.

BACKGROUND OF THE INVENTION

Sanitary liquid filling pumps are used for various applications. In particular, such pumps are used in the food packaging industry to transfer liquid food products such as juice, milk and the like from bulk storage to individual product package units.

Various types of pumps are known in the art. One known type of pump system includes a bulk food product storage tank, a pump and a filling nozzle for filling the individual product packages. In one commercially available system, the pump is oriented vertically and receives the liquid food product at the bottom thereof. The food product is pumped upwardly through the pump into the filling nozzle. At the filling nozzle, the liquid is redirected downwardly into the individual packages.

It has been observed that direction changes in the liquid food product flow path tend to create turbulence in the flowing liquid which can result in foaming. However, it is desirable to avoid foaming for a number of reasons. First, the foamed volume of the food product is greater than an equivalent liquid volume. Thus, the product package could be short filled, or, conversely, the foam could overflow from the package. Second, foaming can result in backflow through the pump and associated system components. Given the high standards of cleanliness established for the food processing industry, such backflow is to be avoided to prevent possible contamination of the pump and associated equipment. Foaming can also adversely impact the overall filling and packaging process and process controls.

In an effort to overcome the foaming problem as well as other, maintenance related problems associated therewith, one known apparatus includes a horizontally oriented pump which discharges into a vertically oriented filling nozzle. Notwithstanding that the directional changes in the product flow path are reduced in such an arrangement, there remains at least one large or extreme directional change in the flow path. Moreover, such angled mounting configurations have added to the complexity of the filling apparatus and thus the overall maintenance required to maintain the system operational.

Accordingly, there continues to be a need for a filling pump which reduces or eliminates turbulence in the flowing food product and the foaming associated therewith. Such a filling pump should provide a straight-through pumping profile with minimum flow obstructions for the flowing food product.

SUMMARY OF THE INVENTION

A flow-through filling pump for receiving a liquid supply and discharging a predetermined amount of the liquid therefrom, provides a compact, straight-through flow profile to permit linear or near linear fluid flow from a supply tank to individual product packages. The pump includes a housing defining a supply chamber and a discharge chamber. The supply chamber is in flow communication with the liquid supply. In one embodiment, the supply chamber and the discharge chamber define a substantially straight, axial liquid flow path.

A piston is positioned in the housing intermediate the supply chamber and the discharge chamber. The piston defines a throat area through which liquid flows through the pump. The piston is movable in a reciprocating manner along the axial liquid flow path between a fill position and a discharge position. The piston provides the driving force for moving the liquid through the pump. A drive assembly is operably connected to and drives the piston.

The pump includes a seal element extending between the piston and the housing to isolate the supply and the discharge chambers and at least a portion of the piston, from a portion of the housing at which the drive assembly operably connects to the piston. In one embodiment, the seal element includes a plurality of flexible diaphragms, namely, an upper diaphragm, a lower diaphragm and a pair of intermediate diaphragms. The upper and lower diaphragms define piston wetted and non-wetted regions, and isolate the liquid in the pump from the intermediate diaphragms.

The upper diaphragm and its adjacent intermediate diaphragm and the lower diaphragm and its adjacent intermediate diaphragm define upper and lower isolation regions, respectively. The upper an lower isolation regions are preferably maintained under vacuum to facilitate smooth movement of the piston and to prevent leakage across the diaphragms from entering the food product stream.

An non-return type inlet valve is positioned in the piston. In a preferred embodiment, the valve includes a plunger mounted to the piston and moveable therewith. The plunger is further movable relative to the piston to permit and to terminate flow of liquid through the valve into the discharge chamber as the piston is moved between the fill position and the discharge position. Preferably, the plunger is mounted to the piston by a coil spring or like biasing element to bias the valve into a closed position.

In one embodiment, the drive assembly is mounted to the housing and is positioned at least in part outside of the housing. The drive assembly includes a drive connector operably connected to the piston which extends through an opening in the housing.

The pump can include an outlet valve mounted in the housing at about the discharge chamber. The outlet valve can be actuated by an actuator independent of the piston to retain the liquid in the discharge chamber and to discharge the liquid therefrom.

In an alternate embodiment, the pump includes a pair of flexible diaphragms extending between the piston and the housing to isolate the piston wetted region from the non-wetted region and to define an isolation region. The pump may include a drive seal extending between the housing and the drive connector. The drive seal and the isolation region define a vacuum region which is preferably maintained under a vacuum.

Other features and advantages of the present invention will be apparent from the following detailed description, the accompanying drawings, and the appended claims.

DETAILED DESCRIPTION OF THE PREFERRED EMBODIMENTS

Figure 1:
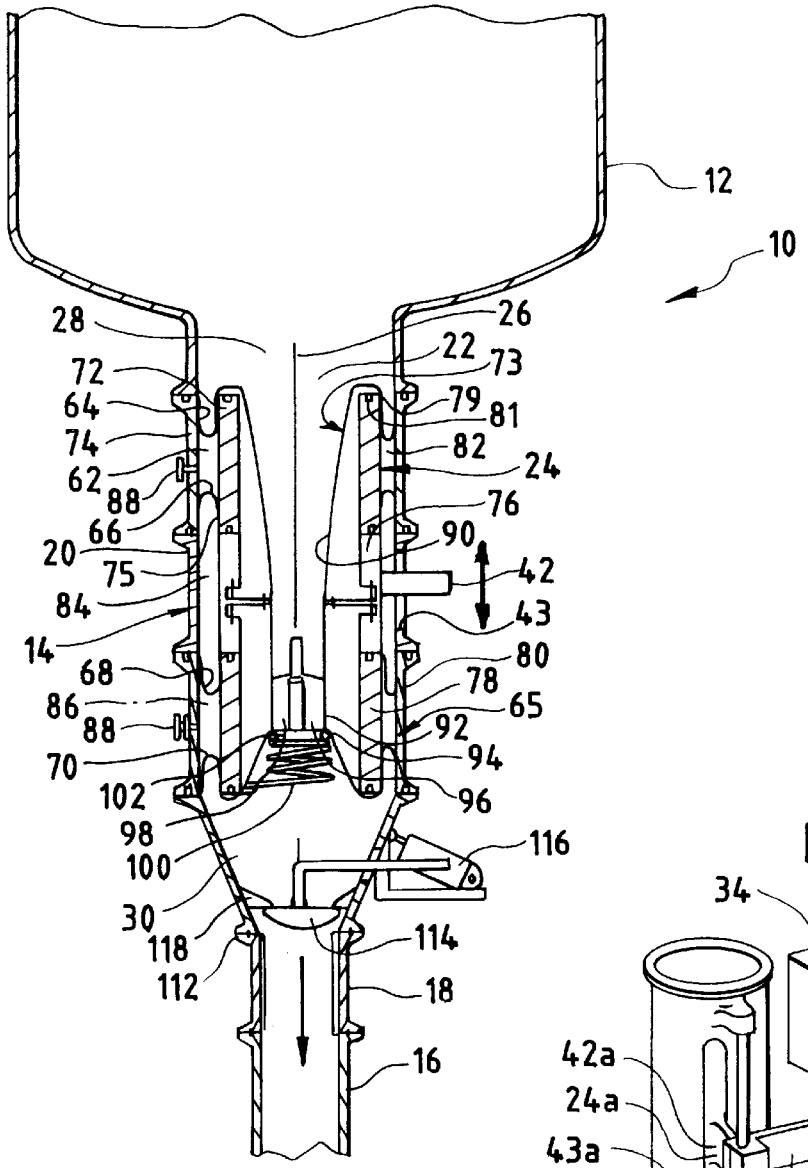
FIG. 1 is a cross-sectional view of a pumping system showing a flow-through vertical filling pump embodying the principles of the present invention, illustrated with a portion of a supply tank, and a portion of a filling nozzle mount.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

With reference now to the figures and in particular, FIG. 1, there is shown a portion of a liquid food product packaging system 10. The system 10 includes generally, a storage tank 12, a flow-through vertical pump 14 in accordance with the principles of the present invention, and a filling nozzle 16, the mount of which nozzle is illustrated in the figures. The pump 14 is configured to discharge a predetermined quantity of the liquid food product through the filling nozzle 16 into individual product packages (not shown). The filling pump 14 of the present invention can provide a simplified flow profile as compared to known filling pumps. The profile may be straight-through, which reduces turbulence in the flowing liquid and thus reduces or eliminates the opportunity for the product to foam.

Figure 2:
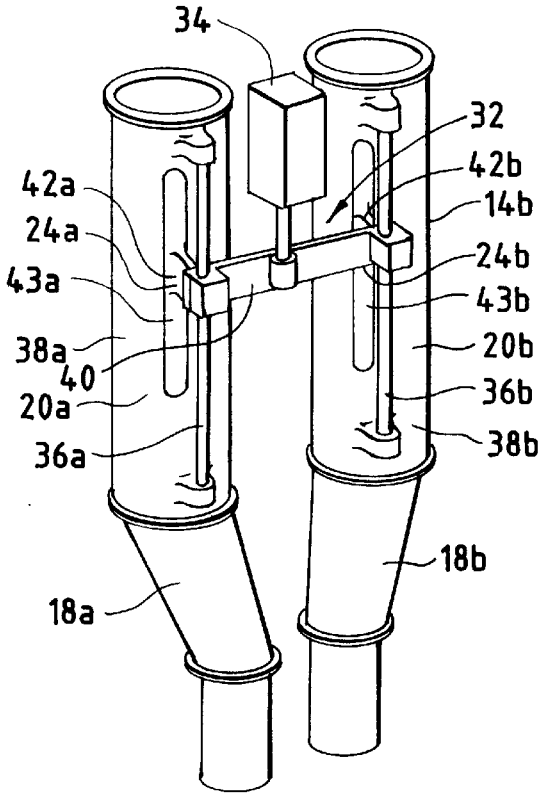
FIG. 2 is a perspective view of a pair of filling pumps, illustrated with a direct drive, linear servo-motor assembly for driving the reciprocating pump pistons in tandem.
Figure 3:
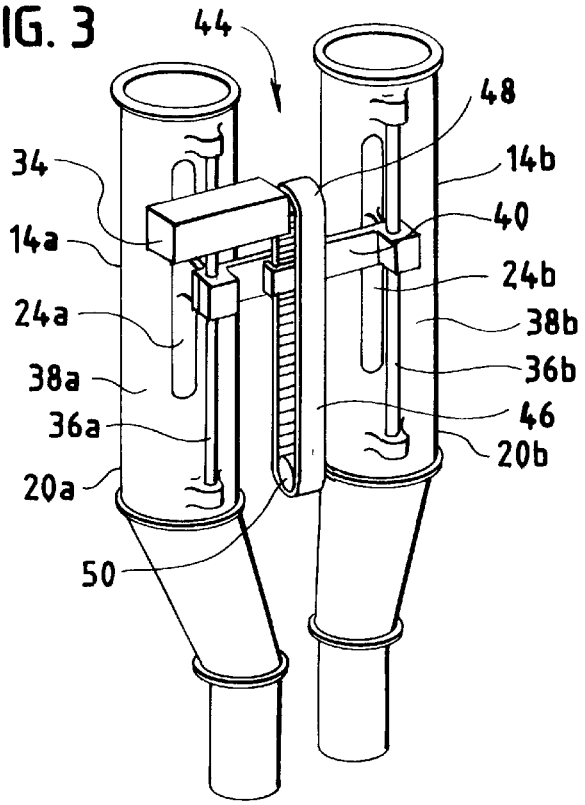
FIG. 3 is a perspective view similar to FIG. 2, illustrating a servomotor driven belt drive assembly for driving the pair of pump pistons in tandem.
Figure 4:
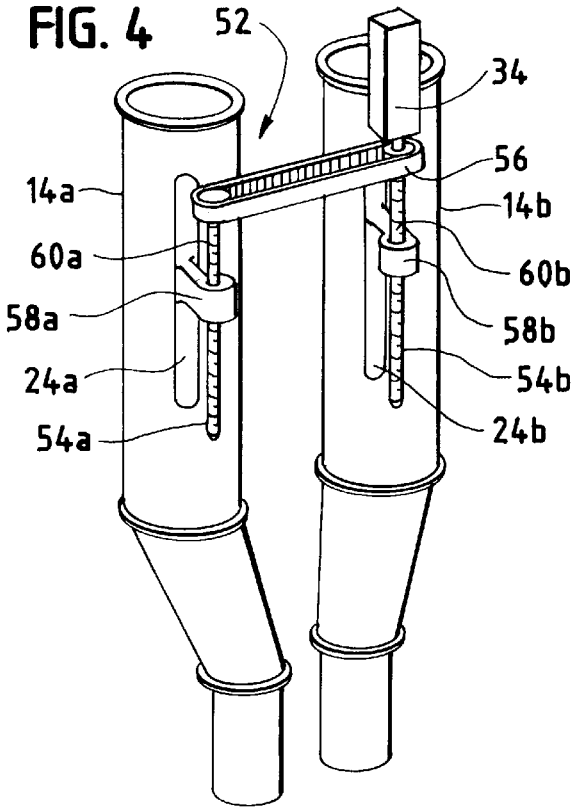
FIG. 4 is a perspective view similar to FIG. 2 illustrating a roller screw drive assembly for driving the pair of pump pistons in tandem.

Advantageously, the present pump 14 also simplifies the mounting configuration necessary to install the pump 14 within the system 10. As seen in FIG. 1, the pump 14 is positioned, preferably linearly, between the tank 12 and the filling nozzle 16. This permits the liquid food product to be pumped from the tank 12 to the filling nozzle 16 with gravity assisting the pumping operation. Referring to FIGS. 2–4, the pump 14 may be positioned slightly off of center or eccentric relative to the filling nozzle 16, with a slightly skewed connecting conduit 18 therebetween. Nevertheless, even in such a slightly eccentric mounting configuration, a tortuous liquid flow path can readily be avoided, and gravity can be used to assist pumping the liquid to the product packages.

The pump 14 includes generally a housing 20 defining a pump chamber 22 having a coaxially positioned reciprocating piston 24 mounted therein. The piston 24 provides the driving force to move the food product through the pump 14. The chamber 22 is in flow communication with the supply tank 12 and defines a fluid flow path, as illustrated at 26 in FIG. 1, relative to the pump 14. Preferably, the fluid flow path 26 has an axial, substantially straight-through profile. In this manner, the pump 14 is connected to the liquid supply tank 12 and to the filling nozzle 16 so as to minimize the number and severity of bends or turns along the entire flow path.

The pump chamber 22 includes a supply chamber 28 in flow communication with the supply tank 12, and a discharge chamber 30 proximate to the filling nozzle 16. The reciprocating piston 24 is positioned in the pump chamber 22 so as to define the supply and discharge chambers 28, 30. The piston 24 moves axially in the pump chamber 22 between a fill position and a discharge position.

As used herein, the terms fill and discharge are in reference to the state or condition of the discharge chamber 30. For example, when the piston 24 is in the fill position, the discharge chamber 30 is filled or is being filled. Conversely, when the piston 24 is in the discharge position, the discharge chamber 30 is empty or is being emptied.

It will be recognized by those skilled in the art that the discharge chamber 30 is filled and is emptied as the piston 24 reciprocates between the fill position and the discharge position. Thus, the discharge chamber 30 fills as the piston 24 moves upwardly, toward the tank 12, into the fill position, and discharges as the piston 24 moves downwardly, toward the filling nozzle 16, into the discharge position.

The piston 24 is driven or actuated by a drive assembly 32. As illustrated in FIG. 2, in which the drive assembly 32 is shown driving a pair of pumps 14*a,b* in tandem, the assembly 32 includes a drive member 34, such as a direct drive, e.g, linear servo-motor (FIG. 2), which is located externally of the housing 20. The assembly 32 includes an elongated guide rod 36*a,b* axially mounted along an outer wall 38*a,b* of each housing 20*a,b*. A drive bar 40 extends between the tandem pumps 14*a,b* and slides along the guide rods 36*a,b*. The bar 40 is operably connected to the motor 34 and is connected to each piston 24*a,b* by a drive connector 42*a,b*. The drive connectors 42*a,b* are mounted to their respective pistons 24*a,b* (see FIG. 1) and extend therefrom through an opening 43*a,b* in their respective housings 20*a,b*.

Alternately, the drive may include a servo-motor driven timing or drive belt arrangement 44 as illustrated in FIG. 3. The belt drive arrangement 44 is similar to the direct drive arrangement 32 and includes a guide rod 36*a,b* positioned on the outer wall 38*a,b* of each housing 20*a,b*. A drive bar 40 extends between the tandem pumps 14*a,b* and slides along the guide rods 36*a,b*. The drive bar 40 is mounted to the drive connectors 42*a,b* extending from each piston 24*a,b*. The belt drive arrangement 44 includes a motor 34 and a drive belt 46 positioned about a driven roller or gear 48 and an idler roller or gear 50. The belt 46 is fixedly connected to the drive bar 40 to drive the pistons 24*a,b*.

A roller screw drive arrangement 52, as illustrated in FIG. 4, may also be used to drive the pistons 24*a,b* of the tandem pumps 14*a,b*. The roller screw arrangement 52 includes a motor 34 and a pair of drive screws 54*a,b*. One of the drive screws 54*b* may be directly connected to the motor 34 an the other screw 54*a* may be driven by an interconnecting drive belt 56. The piston drive connectors 58*a,b* each include a threaded opening 60*a,b* therein adapted to engage the screws 54*a,b*. As the screws 54*a,b* turn, the pistons 24*a,b* are moved upwardly and downwardly in a reciprocating manner. Drive arrangements can also include pneumatic drive systems, electric or electro-mechanical drive systems, such as solenoid drives, and magnetic drive systems. These and other drive arrangements will be recognized by those skilled in the art, and are within the scope of the present invention.

Referring to FIG. 1, the piston 24 is sealed or isolated from contact with the inner wall 62 of the housing 20 and from contact with the liquid by a seal member 65, such as the exemplary flexible diaphragms. As shown in the embodiment illustrated in FIG. 1, the pump 14 includes a series of rolling diaphragms, namely, an upper diaphragm 64, a pair of intermediate diaphragms 66, 68 and a lower diaphragm 70. The diaphragms flex and roll as the piston 24 reciprocates. The upper diaphragm 64 extends from an upper wall 72 of the piston 24 to an upper portion 74 of the housing 20 and prevents liquid that flows into the pump 14 from entering the area between the piston 24 wall and the housing 20.

The intermediate diaphragms 66, 68 extend between the piston 24 at about the drive connection 76 and the housing 20, and permit isolated, direct connection of the drive assembly 32 to the piston 24, such as by the drive connector 42. The lower diaphragm 70 is configured similar to the upper diaphragm 64, but is positioned to extend between the lower piston wall 78 and a lower portion 80 of the housing 20. The lower diaphragm 70 prevents liquid from being pumped into the area between the piston wall 78 and the housing 20 when the pump 14 is discharging.

The diaphragms 64, 70 define a wetted piston region 73 and a non-wetted piston region 75. The diaphragms 64–70 may be retained in place at the piston walls 72, 78 and at the housing 74, 80 by beads 79 integral with the diaphragms 64–70 which engage channels 81 in the piston walls 72, 78 and housing 74, 80, respectively.

The upper and intermediate diaphragms 64, 66 define an upper isolation region 82. Likewise, the intermediate diaphragms 66, 68 define an intermediate isolation region 84, and the lower and intermediate diaphragms 70, 68 define a lower isolation region 86. The upper and lower isolation regions 82, 86 and the intermediate isolation region 84 isolate the liquid from the environs and the drive assembly 32, respectively, thus reducing the opportunity for contaminating the food product.

In a preferred embodiment, the upper and lower isolation regions 82, 86 include vacuum taps 88 to draw and maintain a vacuum in the isolation regions 82, 86. The vacuum in the isolation regions 82, 86 advantageously retains the diaphragms 64–70 in place and facilitates the inclusion of a leak detection arrangement (not shown) to detect leaks across the upper and lower diaphragms 64, 70. The vacuum in the isolation regions 82, 86 also assures that any leakage across the diaphragms 64, 70 will be into the isolation regions 82, 86 rather than into the food product stream.

The pump 14 includes an inner, wetted piston throat area 90 which extends inward of the piston 24, between the upper piston wall 72 and the lower piston wall 78. The throat area 90 defines a flow path for liquid flowing through the pump 14. A valve seat 94 is positioned in the throat area 90 at about a constricted region 92 thereof. The throat area 90 is rigid and may be formed of a food grade plastic or polymeric material.

A non-return type (e.g., unidirectional flow-type) inlet valve 96 is positioned in the throat area 90, and includes a movable valve element 98. In one embodiment, as best seen in FIGS. *7a–b*, the element 98 includes a plunger portion which is operably connected to the piston 24 by a biasing element, such as the exemplary coil spring 100. The coil spring 100 mount biases the inlet valve plunger 98 upwardly into the throat area 90 constricted region 92. In the biased condition, the plunger 98 is seated against the valve seat 94 into a closed position to terminate liquid flow. The biased arrangement permits the valve plunger 98 to move downwardly, out of the constricted region 92, into an open position, to permit flow through the valve 96. The exemplary plunger 98 includes a plurality of flow ports 99 across which the liquid flows when the plunger 98 is in the open position.

As can be seen from FIG. 1, the inlet valve plunger 98 is moveable independent of the piston 24. In a current embodiment, the inlet valve 96 includes a float-type plunger 98 which is urged to the open position by the force of the liquid in the supply chamber 28 on the plunger 98 in conjunction with the upward movement of the piston 24. The force of the liquid together with the upward movement of the piston 24 overcomes the force exerted on the plunger 98 by the spring 100. The inlet valve 96 is closed by the force of the spring 100 on the plunger 98 in conjunction with the downward movement of the piston 24. The valve 96 may include a seal element 102, such as the exemplary O-ring to provide a liquid-tight seal across the valve seat 94.

Other configurations of valves 96 may be used, for example, butterfly valves, rigid and flexible flap valves and the like. These and other valve configurations will be recognized by those skilled in the art, and are within the scope of the present invention.

The pump 14 includes an outlet valve 112 positioned in the discharge chamber 30. The outlet valve 112 includes a plunger portion 114 which may be actuated by an actuator 116 independent of the piston 24. The outlet valve 112 includes a valve seat 118 extending inwardly from the sides of an inner wall of the housing 20 to provide a seating surface for the plunger 114. The plunger 114 is configured to move downwardly, in the direction generally defined by the liquid flow path and away from the seat, to permit the liquid to flow from the discharge chamber into the filling nozzle.

The operation of the pump 14 will now be described with reference to FIGS. 5 and 6. It will be recognized by those skilled in the art that while the operation will be described with respect to the mechanical components of the system 10, the pump system 10 may be monitored and controlled by, for example, an automated process control system, to facilitate automatic, timed actuation of the various components for precise filling of the product packages. While the present description of the operation refers to discrete piston 24 and valve 98, 112 positions, it will be recognized by those skilled in the art that the filling of and discharge from the discharge chamber 30 occur continuously during the piston 24 upstroke and downstroke (illustrated at the bottom of the downstroke in FIG. 5 and at the top of the upstroke in FIG. 6), respectively.

Liquid is stored in the tank 12 and flows, by gravity, into the supply chamber 28 of the pump 14. Referring now to FIG. 5, wherein the piston 24 is shown at rest at about the top of its upstroke, the force of the liquid on the inlet valve plunger 98 in conjunction with the upward movement of the piston 24 forces the valve 96 to open. With the inlet valve 96 open, the discharge chamber 30 fills with liquid. When the piston 24 reaches the top of the upstroke position, the force on the valve plunger 98 is equal to or less than the upward force of the coil spring 100 on the plunger 98, and the valve 96 closes.

As the piston 24 begins its downstroke, the liquid in the discharge chamber 30 becomes pressurized and the outlet valve 112 is opened. The liquid is pumped out of the discharge chamber 30 to the filling nozzle 16. When the piston 24 reaches the bottom of the downstroke position, as shown in FIG. 6, the discharge chamber 30 is fully emptied and outlet valve 112 closes. As the piston 24 begins into a subsequent upstroke, the inlet valve plunger 98 is again forced downward against the bias to open the valve 96 to permit liquid to flow into the discharge chamber 30.

As the piston 24 reciprocates through successive upstrokes and downstrokes, the upper and lower diaphragms 64, 70 roll to permit smooth movement of the piston 24 while maintaining the area between the piston walls 72, 78 and the housing 20 adjacent thereto isolated from the liquid food product. In addition, the intermediate diaphragms 66, 68 roll to permit free movement of the piston 24 while isolating the piston drive connection area 76 from the food product and facilitating upper and lower diaphragm 64, 70 leak detection.

Figure 8:
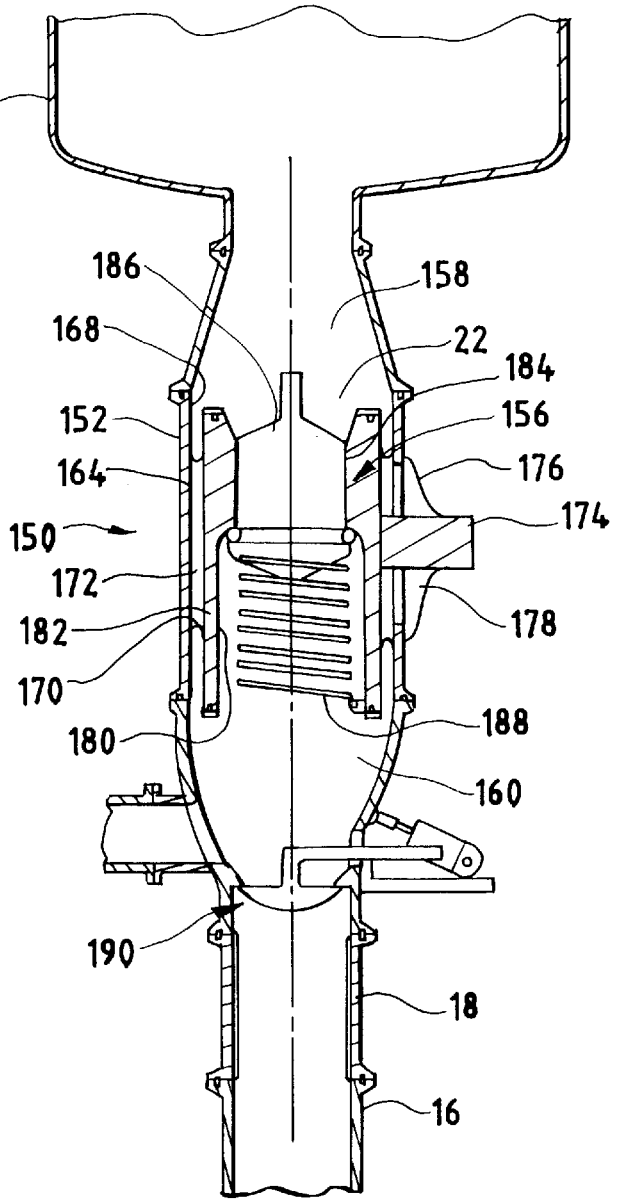
FIG. 8 is a cross-sectional view of an alternate embodiment of the flow through vertical filling pump.

An alternate embodiment 150 of the pump is illustrated in FIG. 8. Similar to the first embodiment 14, the alternate embodiment 150 includes a pump housing 152 defining a chamber 154 having a coaxially positioned reciprocating piston 156 intermediate the supply and discharge chambers 158, 160. The piston 156 reciprocates axially in the chamber 154 between the fill and discharge positions by a drive assembly (not shown) similar to the drive assembly 32 illustrated in FIGS. 2–4.

The piston 156 is isolated from the inner wall 164 of the housing 152 by upper and lower diaphragms 168, 170 which define an isolation region 172. A drive connector 174 extends from the drive member (not shown) to the piston 156 through the isolation region 172. A drive seal 176 extends between and envelopes a portion of the drive connector 174 and a portion of the housing 152 to define a vacuum region 178, which region 178 is maintained under vacuum. The vacuum region 178 isolates the food product from the environs and the drive assembly. Advantageously, the vacuum region 178 also assures that any leakage across the diaphragms 168, 170 is outward from the chamber 154 into the vacuum region 178 rather than into the food product stream.

The piston 156 includes an inner, annular track or channel 180 extending along a lower portion 182 thereof. The track 180 defines an inlet valve 184 which is configured to receive an inlet valve plunger 186 in sliding engagement therewith. The plunger 186 is mounted to the piston 156, by a biasing member such as the illustrated coil spring 188. The spring 188 biases the plunger 186 so as to close the valve 184. The alternate embodiment 150 includes an actuated discharge valve 190 which is configured similar to and operates similar to the discharge valve 112 of the embodiment 112 of FIGS. 1–6.

Figure 5:
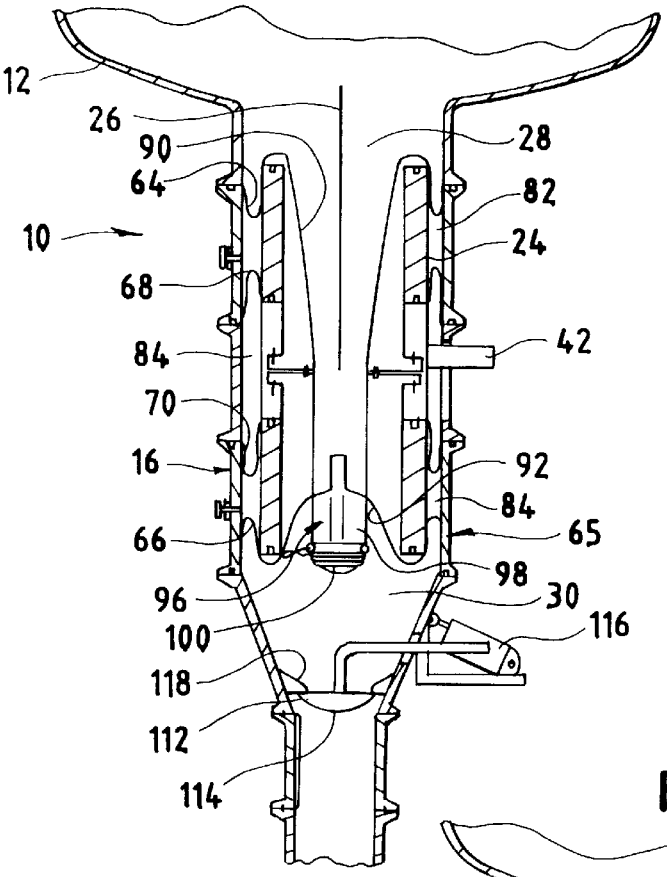
FIG. 5 is a cross-sectional view similar to FIG. 1, illustrating the piston in the fill position, showing the inlet valve open and the discharge valve closed.
Figure 6:
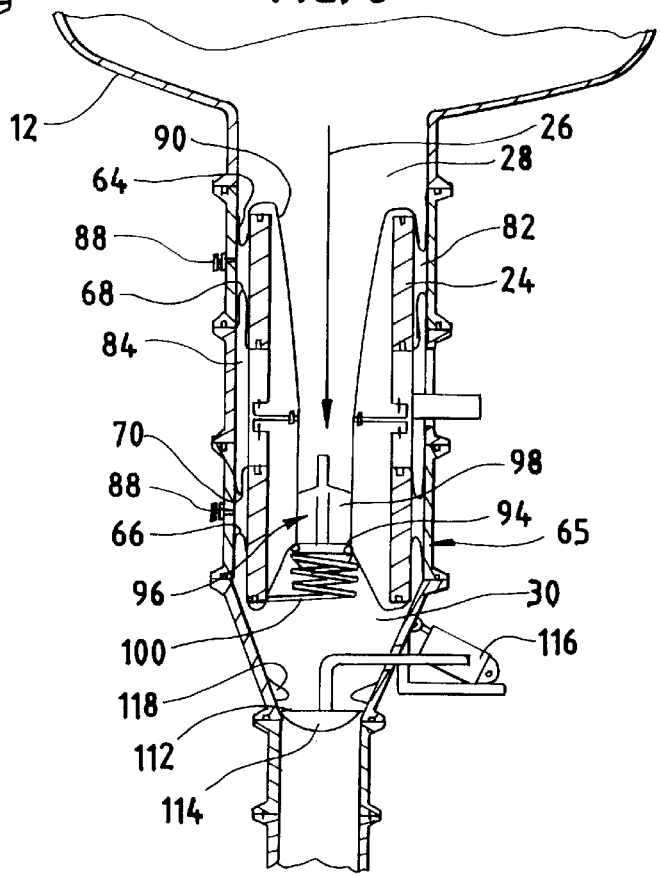
FIG. 6 is a cross-sectional view similar to FIG. 1, illustrating the piston in the discharge position, showing the inlet valve closed and the discharge valve open.
Figure 7A:
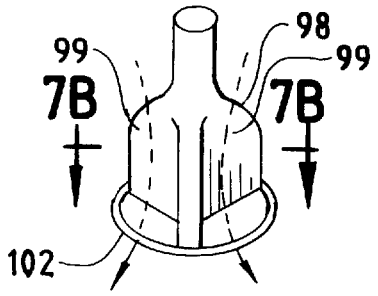
FIG. 7*a* illustrates an exemplary plunger which may be positioned in the piston at about the throat area thereof, the flow of liquid across the plunger and through flow ports formed in the plunger being illustrated by lines in phantom.
Figure 7B:
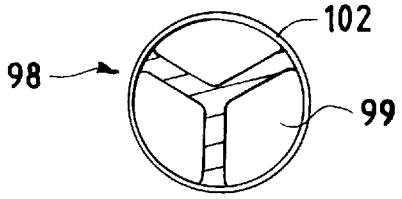
FIG. 7*b* is a cross-sectional view of the plunger taken along line 7*b*—7*b* of FIG. 7*a*.

Operation of the pump 150 is similar to the embodiment 14 of FIGS. 1 and 5–6. As the piston 156 moves downward to discharge the liquid food product, the inlet valve plunger 186 moves upwardly to close the valve 184 and terminate the flow of liquid product into the discharge chamber 160. Likewise, as the piston 156 moves upwardly, the inlet valve plunger 186 is forced down, to open the valve 184, to permit the flow of liquid into the discharge chamber 160. The outlet valve 190 is timed in coordination with movement of the piston 156 to pump the liquid food product from the discharge chamber 160.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A flow-through filling pump for receiving a liquid supply and discharging a predetermined amount of the liquid therefrom, comprising:

a housing defining a supply chamber and a discharge chamber, the supply chamber being in flow communication with the liquid supply, the supply chamber and the discharge chamber defining a liquid flow path;

a piston positioned in the housing intermediate the supply chamber and the discharge chamber, the piston being movable along the axial liquid flow path between a fill position and a discharge position;

a drive assembly operably connected to the piston and configured to move the piston in a reciprocating manner between the fill and discharge positions;

a seal member including a plurality of flexible diaphragms each extending between the piston and the housing, the seal member configured so as to isolate the supply and the discharge chambers and at least a portion of the piston from a portion of the housing at which the drive assembly operably connects to the piston; and an inlet valve including a valve element mounted to the piston and moveable therewith, the valve element being further movable relative to the piston to permit and to terminate flow of liquid through the valve into the discharge chamber as the piston is moved between the fill position and the discharge position.

2. The flow-through filling pump in accordance with claim 1 wherein the drive assembly is mounted to the housing and is positioned at least in part outside of the housing, the drive assembly including a drive connector operably connected to the piston and extending through an opening in the housing.

3. The flow-through filling pump in accordance with claim 1 wherein the seal member is configured to isolate the liquid supply from the drive assembly.

4. The flow-through filling pump in accordance with claim 1 including two pairs of flexible diaphragms, a first pair being configured to provide liquid-tight isolation of the piston from a portion of the housing and a second pair configured to provide liquid-tight isolation of the drive assembly from the first pair of diaphragms.

5. The flow-through filling pump in accordance with claim 1 wherein the valve element includes a movable plunger portion.

6. The flow-through filling pump in accordance with claim 1 wherein the valve element is biasedly mounted to the piston and is movable independently thereof.

7. The flow-through filling pump in accordance with claim 1 including an outlet valve mounted to the housing at about the discharge chamber and configured to retain the liquid in the discharge chamber and to discharge the liquid therefrom.

8. The flow-through filling pump in accordance with claim 6 wherein the valve includes a valve seat and wherein the valve element includes a seal element thereon adapted to compact with the valve seat to establish a liquid-tight seal across the valve.

9. The flow-through filling pump in accordance with claim 4 wherein the diaphragms define isolation regions therebetween and wherein at least some of the isolation regions are maintained under a vacuum.

10. A flow-through filling pump for receiving a liquid supply and discharging a predetermined amount of the liquid therefrom, comprising:

a pump housing defining a chamber, the chamber being in flow communication with the liquid supply and defining a liquid flow path therethrough;

a reciprocating piston positioned in the housing so as to define a supply region and a discharge region, the piston including a wetted region and a non-wetted region, and being movable along the axial liquid flow path between a fill position and a discharge position;

a drive assembly operably connected to the piston at the non-wetted region and configured to move the piston in a reciprocating manner between the fill and discharge positions;

a seal member including a pair of flexible diaphragms extending between the piston and the housing, the seal member adapted to isolate the piston wetted region from the non-wetted region; and an inlet valve movable relative to the piston to permit and to terminate flow of liquid through the valve into the discharge region as the piston is moved between the fill position and the discharge position.

11. The flow-through filling pump in accordance with claim 10 including a second pair of flexible diaphragms extending between the piston non-wetted region and the housing intermediate the first pair of diaphragms and the drive assembly.

12. The flow-through filling pump in accordance with claim 11 including a first isolation region defined by one of the first pair of flexible diaphragms and one of the second pair of flexible diaphragms, and including a second isolation region defined by the other of the first pair of flexible diaphragms and the other of the second pair of flexible diaphragms.

13. The flow-through filling pump in accordance with claim 12 wherein at least one of the first and second isolation regions is maintained under a vacuum.

14. The flow-through filling pump in accordance with claim 10 wherein the flexible diaphragms define an isolation region therebetween.

15. The flow-through filling pump in accordance with claim 14 including a drive seal extending between the housing and a portion of the drive assembly, wherein the drive seal and the isolation region define a vacuum region which is maintained under a vacuum.

16. The flow-through filling pump in accordance with claim 10 wherein the drive assembly is mounted to the housing and is positioned at least in part outside of the housing, the drive assembly including a drive connector operably connected to the piston and extending through an opening in the housing.

17. The flow-through filling pump in accordance with claim 10 wherein the inlet valve is mounted to the piston and includes a valve element movable relative to the piston.

18. The flow-through filling pump in accordance with claim 17 wherein the movable element is a plunger.

19. The flow-through filling pump in accordance with claim 18 wherein the plunger is biasedly mounted to the piston and is movable independently thereof.

20. The flow-through filling pump in accordance with claim 17 wherein the valve includes a valve seat and wherein the valve element includes a seal element thereon adapted to coact with the valve seat to establish a liquid-tight seal across the valve.

* * * * *